US005293761A

United States Patent [19]

Jang

[11] Patent Number: 5,293,761

[45] Date of Patent: Mar. 15, 1994

[54] BOILING-WATER CLOTHES WASHING MACHINE

[75] Inventor: Ki H. Jang, Suweon, Rep. of Korea

[73] Assignee: Samsung Electronics Co., Ltd., Suwon, Rep. of Korea

[21] Appl. No.: 961,831

[22] Filed: Oct. 16, 1992

[30] Foreign Application Priority Data

Oct. 16, 1991 [KR] Rep. of Korea ..... 91-17217

[51] Int. Cl.[5] ..... D06F 39/08; D06F 39/14

[52] U.S. Cl. ..... 68/15; 68/196; 68/207

[58] Field of Search ..... 68/15, 23.5, 196, 207

[56] References Cited

U.S. PATENT DOCUMENTS

| | | | |
|---|---|---|---|
| 2,871,871 | 2/1959 | Conlee | 68/207 X |
| 4,809,524 | 3/1989 | Sickert et al. | 68/207 X |

FOREIGN PATENT DOCUMENTS

| | | | |
|---|---|---|---|
| 1442770 | 5/1966 | France | 68/207 |
| 114599 | 5/1987 | Japan | 68/207 |
| 1326688 | 7/1987 | U.S.S.R. | 68/15 |
| 716245 | 9/1954 | United Kingdom | 68/196 |

*Primary Examiner*—Philip R. Coe

*Attorney, Agent, or Firm*—Burns, Doane, Swecker & Mathis

[57] ABSTRACT

A clothes washing machine for washing clothes in boiling water comprises a tub enclosing a wash tank. The tub has an upstanding wall with a rim. A cover for the tub includes inner and outer downwardly projecting flanges forming a groove extending continuously around the periphery of the cover to prevent the escape of steam. The rim of the tub is tightly received in the groove. A water infeed line for the tub includes an enlarged chamber for relieving the pressure of incoming water to provide a smooth inflow of water.

11 Claims, 2 Drawing Sheets

BOILING-WATER CLOTHES WASHING MACHINE

BACKGROUND OF THE INVENTION

The present invention is related to a boiler-water clothes washing machine including a heater mounted in a tub to boil washing water at a predetermined temperature.

PRIOR ART

A conventional warm water clothes washing machine operates a heater in a water container corresponding to the washing procedures to warm washing water, but it generates much steam vapor which rises to the upper portion of the tub while heating washing water at a high temperature. Therefore, during the operation of the heater the steam vapor requires perfect sealing with respect to the upper opening that there be achieve portion of the tub for safety, i.e., protecting the electrical components of the washing machine as well as reducing the thermal losses.

A tub cover of the washing machine is usually fitted into the upper inner diameter portion of the tub with its outer periphery edge being projected downward, and the outer periphery edge is then coupled by means of a number of bolts to the upper portion of the tub. The tub cover also includes a center opening covered an inner cover positioned to enable a user to insert/remove washing clothes therefrom, a hole formed at a predetermined size to supply washing water therethrough and a water feeder communicating with an outside water tap.

However, this clothes washing machine is available for washing clothes with warm water, not boiled water. That is to say, the tub cover as well as the inner cover would be deformed at a high temperature to create wide clearances relative to the wall portion of the tub and against each other, thereby causing great leakage of steam vapors thermal losses. Even though the water feeder is very simple in configuration, it has the critical problem that under the assumption that the pressure of washing water from the water tap is uneven, the strong pressure of washing water causes difficulties in achieving a smooth water supply and furthermore flow across the tub cover, thereby producing damage to electrical parts of the washing machine.

Such a configuration is typically disclosed in U.S. application Ser. Nos. 07/885,885 and 07/884,196, each of which shows a water container structure and a tub cover structure for laundering clothes at a very high temperature, for example 95° C.

In order to resolve these problems, a main object of the present. invention is to provide a boiling-water clothes washing machine which is capable of processing wash water of a very high temperature in addition to hot water washing.

Another object of the present invention is to provide a boiling-water clothes washing machine including an inner cover having the effective sealing with the upper portion wall of a tube without deforming at a high temperature.

Another object of the present invention is to provide a boiling-water clothes washing machine including a water supply apparatus for providing smooth water supply of wash water communicating with an outside tap without disturbing the opening/closing of a tub cover.

SUMMARY OF THE INVENTION

The present invention comprises a boiling clothes washing machine, in which a tub has a cover made of materials withstanding a high temperature and including inner and outer projecting portions projected downward at a predetermined spacing to form a coupling groove. The groove tightly receives an upper rim of the tub to prevent distortion of the cover. A water supply apparatus includes a water feeding fitting connected to a water tap, an intermediate connector for adjusting the supplied washing water pressure and a water feeder which is a corrugated pipe made of flexible materials.

Thus, the present invention provides a prominent washing effect with the high temperature process of cleaning, reduces loss due to the tight seal of the inner cover on the tube during the hot or boiling water wash cycle, and protects the electrical components of a heater by preventing the leakage of the steam vapor.

BRIEF DESCRIPTION OF THE DRAWINGS

The present invention will be now explained in detail with reference to the attached drawings, in which.

DETAILED DESCRIPTION OF A PREFERRED EMBODIMENT OF THE INVENTION

Figure 1:
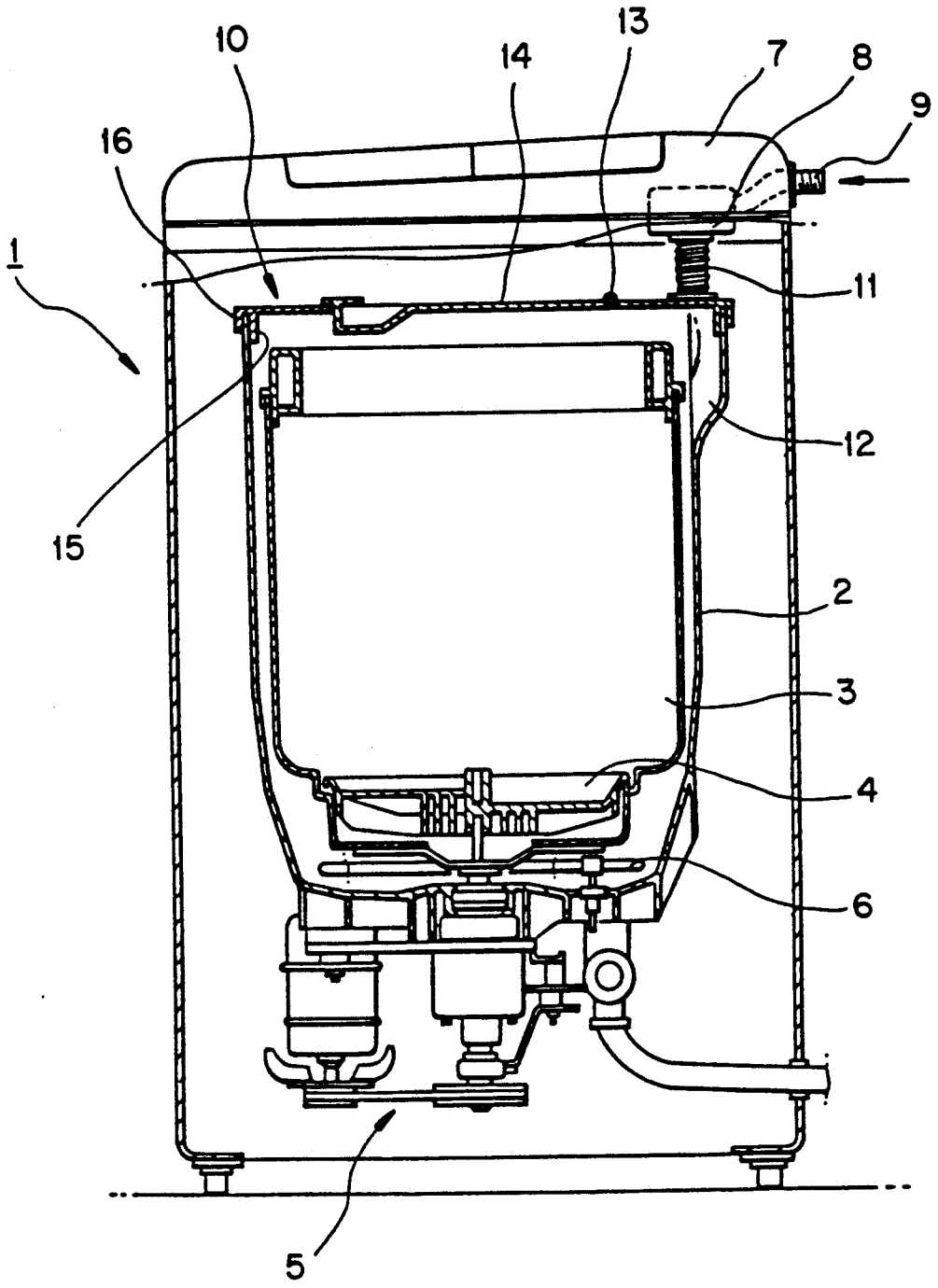
FIG. 1 is a vertical cross-sectional view illustrating a boiling-water clothes washing machine according to the present invention.
Figure 2:
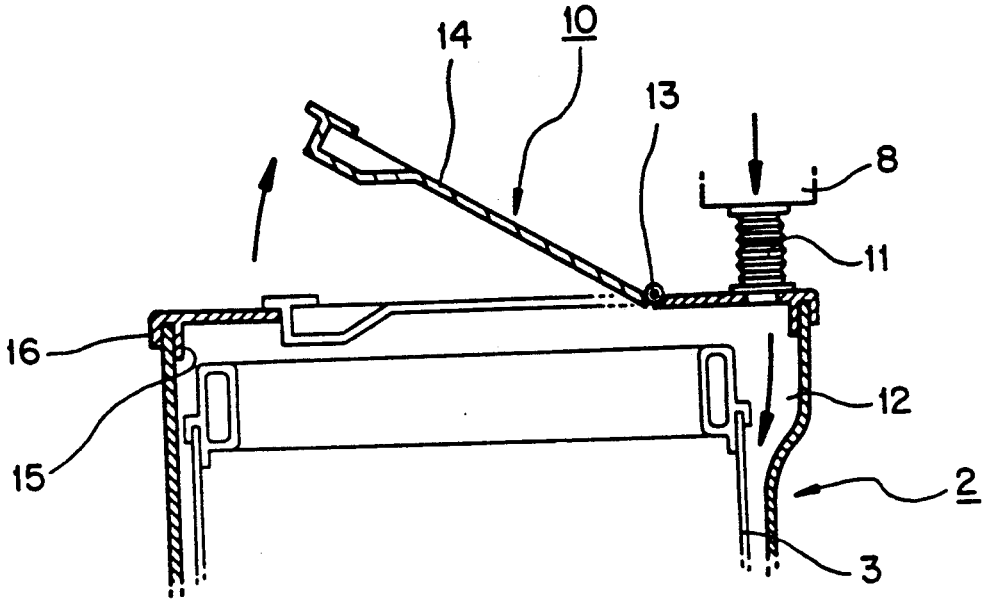
FIG. 2 is an enlarged fragmentary view of FIG. 1.
Figure 3:
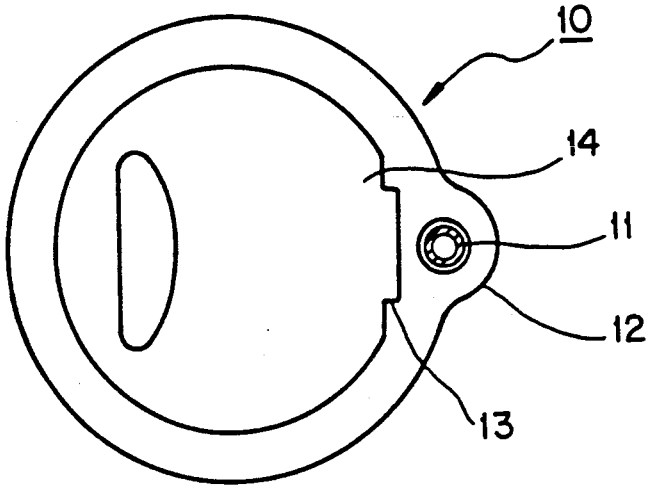
FIG. 3 is a plan view of the upper surface of a tub cover according to the present invention.

FIG. 1 shows the configuration of a boiling-water clothes washing machine. A body 1 forms an internal space and includes a cover 7. That internal space contains a tub 2 which retains washing-water therein. Disposed within an internal space formed by the tub is a wash tank 3 which receives clothing. The tub includes the wash tank 3 and a heater 6 mounted between the outer bottom of the wash tank 3 and its inner bottom. The wash tank 3 has an agitator 4 positioned therein which is connected to a driving portion 5 constituted as a conventional gear box and motor.

The tube has a tub cover 10 and is provided with a water supply apparatus. The tub 2 includes a washing water guide conduit 12 slightly projected outward from its upper wall to receive the supplied wash water. The tub cover 10 is made of materials capable of withstanding a high temperature and mounted on the upper wall of the tub in a manner that two inner and outer projecting flanges 15 and 16 of the cover are extended continuously around its periphery edge to form a coupling groove, with the rim of the tub upper wall being tightly fitted in the groove. The tub cover 10 also includes an inner door or cover 14 pivoted to a hinge 13 for covering an access opening which enables clothes to be loaded into/removed from the wash tank 3. Therefore, the seal of the tub 10 blocks the leakage of the steam vapor.

The water supply apparatus includes an intermediate connector 8 having a predetermined volume to adjust the pressure of the inflow wash water, a water feeding fitting 9 directed to a water tap and a water feeder 11 coupled to the intermediate connector 8 for feeding wash water into the tub. The feeder 11 communicates with a hole formed on the tub cover 10. The intermediate connector 8 comprises an empty box forming an enlarged chamber which relieves the pressure of washing water from the water received feeding fitting 9. The water feeder 11 is made of flexible material in the form of a corrugated hose. Therefore, the pressure-adjusted wash water is smoothly supplied to the tub without flowing across the tub cover 10.

Accordingly, the present invention protects electrical equipment from damage caused by steam vapors and reduces the thermal loss, thereby promoting the associated optimal performance of the washing machine. Furthermore, it is noted that the installation of a tub cover allows clothes to be washed at temperatures higher than a conventional washing machine which uses hot water, thereby increasing the washing efficiency of the washing machine.

What is claimed is:

1. A clothes washing machine comprising:

an outer body forming a first internal space and having a first cover;

a tub disposed within said first internal space and forming a second internal space, said tub including a first upstanding side wall terminating in an upper rim, a second cover having an outer peripheral portion engageable with said upper rim to close said second internal space, and an access door disposed in said second cover inwardly of said outer peripheral portion, said access door being openable for affording access to said second internal space;

a wash tank disposed within said second internal space and beneath said access door for receiving clothes when said access door is open, said wash tank having a second upstanding side wall; and water guiding means connectible to a water source for guiding wash water through said outer body and directly to a portion of said second internal space disposed between said first and second upstanding side walls.

2. A clothes washing machine according to claim 1 wherein said water guiding means is connected to said second cover at a location directly above said portion of said second internal space.

3. A clothes washing machine according to claim 1 wherein said water guiding means extends from said first cover to said second cover.

4. A clothes washing machine according to claim 1 wherein said water guiding means includes a first conduit having one end connected to a port in said outer body, a second conduit having one end connected to a port in said tub, and an intermediate connector connected to the other ends of said first and second conduits for adjusting the pressure of inflowing wash water.

5. A clothes washing machine according to claim 4 wherein said intermediate connector comprises an enlarged empty chamber.

6. A clothes washing machine according to claim 4 wherein said second conduit is flexible.

7. A clothes washing machine according to claim 1 wherein said access door is swingable about a hinge mounted along an edge thereof.

8. A clothes washing machine according to claim 1 wherein said tub includes heating means for heating incoming wash water to substantially a boiling temperature.

9. A clothes washing machine according to claim 1 wherein said outer peripheral portion of said second cover includes a downwardly open groove receiving said upper rim.

10. A clothes washing machine comprising:

an outer body forming a first internal space and having a first cover;

a tub disposed within said first internal space and forming a second internal space, said tub including:

a first upstanding side wall terminating in an upper rim, a second cover having a downwardly open groove along its outer periphery for receiving said upper rim to close said second internal space, and an access door swingably mounted to said cover and being openable independently of said second cover for affording access to said second internal space, a wash tank disposed within said second internal space and beneath said access door for receiving clothes when said access door is open, said wash tank having a second upstanding side wall; and water guiding means connectible to a water source for guiding wash water through said outer body and directly into a portion of said second internal space located between said first and second upstanding side walls, said water guiding means comprising:

a first conduit having one end connected to a port in said outer body, a second conduit having one end connected to a port in said tub which is located directly above said portion of said second internal space, and an intermediate connector connected to the other ends of said first and second conduits for adjusting the pressure of inflowing wash water, said intermediate connector comprising an enlarged empty space.

11. A clothes washing machine according to claim 10 wherein said tub includes heating means for heating wash water substantially to a boiling temperature.

* * * * *